US005346217A

United States Patent [19]

Tsuchiya et al.

[11] Patent Number: 5,346,217

[45] Date of Patent: Sep. 13, 1994

[54] HOLLOW METAL ALLOY WOOD-TYPE GOLF HEAD

[75] Inventors: Kazuhiro Tsuchiya, Hamamatsu; Toshiharu Hoshi, Shizuoka; Atsushi Tsuchida; Kenzaburo Iijima, both of Hamamatsu, all of Japan

[73] Assignee: Yamaha Corporation, Japan

[21] Appl. No.: 832,057

[22] Filed: Feb. 6, 1992

[30] Foreign Application Priority Data

Feb. 8, 1991 [JP] Japan ..... 3-039227
Jun. 14, 1991 [JP] Japan ..... 3-170720

[51] Int. Cl.[5] ..... A63B 53/04

[52] U.S. Cl. ..... 273/167 R; 273/167 H; 273/167 J; 273/78; 273/172

[58] Field of Search ..... 273/167 R, 167 H, 167 J, 273/172, 78

[56] References Cited

U.S. PATENT DOCUMENTS

| | | | |
|---|---|---|---|
| 4,026,561 | 5/1977 | Baldorossi | 273/77 A |
| 4,432,549 | 2/1984 | Zebelean | 273/167 H |
| 4,511,145 | 4/1985 | Schmidt | 273/167 H |
| 5,004,241 | 4/1991 | Antonious | 273/167 H |
| 5,028,049 | 7/1991 | McKeighen | 273/167 H |
| 5,042,806 | 8/1991 | Helmstetter | 273/167 H X |
| 5,056,705 | 10/1991 | Wakita et al. | 273/167 H |
| 5,060,951 | 10/1991 | Allen | 273/167 H |
| 5,067,715 | 11/1991 | Schmidt et al. | 273/167 H X |
| 5,154,425 | 10/1992 | Niskanen et al. | 273/167 J |

FOREIGN PATENT DOCUMENTS 0409233 1/1991 European Pat. Off. ..... 273/167 H

OTHER PUBLICATIONS

"Choice Magazine", Metal Head Article, Nov. 1992, p. 79, 90.

"Golf Digest", Matsuo Article, May 1992, pp. 60–65.

The Condensed Chemical Dictionary (New York:Van Nostrand Reinhold Ltd.) 1981, p. 701.

*Primary Examiner*—Jessica J. Harrison
*Assistant Examiner*—William M. Pierce
*Attorney, Agent, or Firm*—Ostrolenk, Faber, Gerb & Soffen

[57] ABSTRACT

In construction of a wood club head having a main body of a hollow metallic shell construction, the face thickness is limited to 2 to 4 mm and the entire head volume is limited to 190 cc or larger for enlargement of its sweet spot. The enlarged sweet spot assures a long flying distance of a ball in an intended direction through its improved mating with the ball at the very moment of striking.

5 Claims, 5 Drawing Sheets

HOLLOW METAL ALLOY WOOD-TYPE GOLF HEAD

BACKGROUND OF THE INVENTION

The present invention relates to a golf wood club head and a method for producing the same, and more particularly relates to improvement in construction and production of a golf wood club head having a hollow metallic shell construction.

In general, it is very difficult for beginner level golfers to maintain stable swing at striking balls and unstable swing causes a ball to come into impact contact with various sections around the sweet spot on a club head. Incorrect impact contact of the ball with the sweet spot often results in error in shot and, even when shot itself is performed without fail, ball tends to fly in an unintended direction. The more one intends to have correct shot on the sweet spot, the less one can swing the club strongly and such suppressed swing only ends in short flying distance.

In order to make up for such poor manipulation at striking balls, it is broadly wanted by beginner level golfers to have a club head with an enlarged sweet spot and a light weight construction.

An enlarged sweet spot assures constant positioning of its impact contact with balls even with unstable swing by beginner level golfers and, as a consequence, the ball flies in an intended direction. In addition, the enlarged sweet spot mentally allows a golfer to swing the club stronger in order to have a long flying distance of the ball.

Golf wood club heads now in market and practical use are roughly classified into three types, i.e. a metallic head having a shell made of cast metal such as stainless steel and titanium, a wooden head having a shell made of woods such as persimmon and a CFRP club having a shell made of plastics reinforced by fibers such as carbon fibers.

In order to enlarge the sweet spot on such a wood club head, it is theoretically thinkable to increase the entire size, i.e. the volume, of the club head, thereby raising its moment of inertia. In practice, however, an increased size is inevitably accompanied with an increased weight of the club head which allows no quick swing at striking balls in particular in the ease of a golfer of a low physical abilities. Slow swing does not provide a strong impact on a ball at striking and, as a consequence, the ball cannot fly over a long distance.

The total weight of a club head has an upper limit of about 210 g in the case of general golfers of an ordinary physical abilities and presence of such an upper limit in weight bars limitless enlargement of the sweet spot on a club head. Enlargement in sweet spot is suppressed from this point of view too.

In the case of wooden golf club heads, relatively low specific gravity special to wooden materials allows appreciable enlargement in sweet spot without any serious increase in weight. Nevertheless, it is difficult with wooden materials to expect stable supply of constant quality and, sometimes, reliable supply of sufficient amount. Such unstable features in supply system is quite unsuited for mass-production. In addition, it is difficult to fix the position of the center of gravity in a club head stably. Further, due to the above-described limitation in weight, the volume of a wooden club head has an upper limit of, at highest, about 190 cc. and such a limited increase in size does not assure enlargement in sweet spot of a desirable extent.

CFRP club heads allow free increase in size, i.e. in volume. However, their relatively low moment of inertia near 2,700 g*cm$^2$ allows no free enlargement in sweet spot as in the case of the wooden club heads.

In major cases of production, a club head has a face of 8 mm thickness (t1), a crown of 3 mm thickness (t2) and a sole of 10 mm thickness (t3) including a sole plate. It is in particular difficult to produce a club head having a face which is thin enough to allow large elastic flexion. Poor flexion of the face causes poor mating of the face with a ball which, as a consequence, cannot fly over a long distance in an intended direction.

From the foregoing, sufficiently enlarged sweet spot is obtained in a metallic club head of a hollow construction which has a face of 2 to 3.5 mm thickness (t1), a crown of 0.6 to 2.0 mm thickness (t2), more preferably of about 1.5 mm thickness and a sole of 1 to 3 mm thickness (t3). It should be appreciated that such a hollow construction of the club head enables sufficient enlargement in sweet spot without any corresponding serious increase in weight.

Conventional metallic club heads are in general made of fine cast material which is significantly large in specific gravity. It is infeasible with such cast material to produce a hollow construction with a thin shell because of various process demands in production. Flow of molten metal must be kept correctly in mould used for production and generation of cast defects must be prevented in order to present continuous mechanical strength in the product. These process demands all hinder formation of a thin shell for the light weight, large hollow construction of the club head. Further, increase in size, i.e. in volume results in undesirable increase in weight because of the relatively high specific gravity of the metallic materials.

When the thickness of the club head main body falls short of 3.5 mm, its face cannot endure impact at striking balls. In order to cover this deficit, it is necessary to insert into the face section a plurality of ribs in a matrix or honeycomb arrangement. In addition when such ribs of, for example, 1.5 to 2.0 mm thickness are inserted into the face section, cast defects and/or segregation are apt to be generated during casting process. Not only such a trouble in production, presence of such ribs in the face degrades flexion of the face at striking balls, which poses no sufficient repulsion on balls to be striken by the face. Such poor repulsion results in significant difference in behaviour time between elastic flexion of the face and elastic deformation of the ball. As a consequence, there is little coincidence between the recovery forces of the face and the ball resulted from their elastic recovery. Thus flexion of the face cannot be effectively utilized for deformation recovery of the ball and enhancement in speed of the ball after striking, thereby causing short fly of the ball in an unintended direction.

When a club head main body is made of stainless steel cast material, the material has a moment of inertia in a range from 2400 to 2500 g*$^2$ and a specific inertia value "moment of inertia/specific gravity" of the material in a range from 300 to 320. These values are too small for the material to be used for a club head main body. As a conventional, the moment of inertia of a golf club head is a measure of the resistance to twisting or angular acceleration of the golf club head about its center of gravity.

In connection with the conventional club head materials, their proof stress (GPa) and density or specific gravity (g/cm$^3$) are given in Table 1 whereas their size, weight, volume, moment of inertia and the specific inertia value "moment of inertia/specific gravity" are given in Tables 2 and 3. In Table 2, a height "a" refers to the distance between the crown and the sole, a width "b" refers to the distance between the toe and heel sides of the face and a length "c" refers to the distance from the face to the back of a club head main body.

TABLE 1

| Material | Proof stress (GPa) | Density (g/cm$^3$) |
|---|---|---|
| Persimmon | 20 | 0.8 |
| Carbon | 180 | 1.6 |
| Stainless (steel cast) | 90 | 7.9 |
| Ti alloy (cast) | 80 | 4.5 |
| Ti alloy (rolled) | 120 | 4.5 |

TABLE 2

| Material | Dimension in mm. t1 | a | b | c | Weight in g. | Volume in cc. |
|---|---|---|---|---|---|---|
| Persimmon (rigid) | — | 42 | 81 | 82 | 197 | 187 |
| Carbon (hollow) | 8 | 42 | 81 | 82 | 195 | 245 |
| | 8 | 41 | 73 | 74 | 201 | 194 |
| Stainless steel cast | 3.1 | 36 | 68 | 71 | 205 | 148 |
| (hollow) | 3.1 | 41 | 69 | 71 | 204 | 168 |
| | 3.0 | 40 | 71 | 71 | 190 | 170 |
| Ti alloy cast | 3.3 | 40 | 74 | 83 | 200 | 206 |

TABLE 3

| Material | Moment of inertia (g*cm$^3$) | Specific inertia value | Use of ribs |
|---|---|---|---|
| Persimmon (rigid) | 1900~2000 | 2500 | none |
| Carbon (hollow) | 2625 | 1640 | none |
| | 2458 | 1540 | none |
| Stainless steel cast | 2471 | 310 | 2 mm |
| (hollow) | 2490 | 315 | 2 mm |
| | 2426 | 307 | 1.5 mm |
| Ti alloy cast | 3204 | 712 | none |

SUMMARY OF THE INVENTION

It is the object of the present invention to enable enlargement in sweet spot of a golf wood club head having a hollow metallic shell construction without any substantial increase in weight as well as difficulty in production.

In accordance with the basic aspect of the present invention, a club head main body has a face of a thickness in a range from 2 to 4 mm and a volume of 190 cc. or larger.

In a preferred embodiment of the invention, the thickness of the face is 3.5 mm or smaller, more preferably 2.5 mm or smaller; the height of the face is 40 mm or larger, more preferably 45 mm or larger: and the width of the face is 70 mm or larger, more preferably 80 mm or larger.

When the dimensions of the club head main body fall outside the above-described limits, the face of the club head exhibits poor flexion causing its poor mating with balls and reduction in sweet spot. As a consequence, no good control on balls is resulted.

In a preferred embodiment of the present invention, the entire volume of the club head is in a range from 200 to 230 cc. With these values, the resultant moment of inertia is 3000 g*cm$^2$ or larger and the specific inertia value is 400 or larger.

The metallic material used for the shell of the club head main body are subjected to plastic working.

In a further preferred embodiment of the present invention, at least a part of the shell of the club head main body is made of Ti alloy of a composition which contains 3 to 6% by weight of Al, 2 to 4% by weight of V, 1 to 3% by weight of Mo, 1 to 3% by weight of Fe and Ti in balance.

In a further preferred embodiment of the present invention, at least a part of a club head shell is made of Ti alloy containing 3 to 6% by weight of Al, 2 to 4% by weight of V, 1 to 3% by weight of Mo, 1 to 3% by weight of Fe and Ti in balance, and the shell is then subjected to heating at a temperature in a range from 700° to 900° C. for solution treatment which is followed by a further heating at a temperature in a range from 400° to 600° C. for 1 to 20 hours for aging treatment.

DESCRIPTION OF THE PREFERRED EMBODIMENTS

Figure 1:
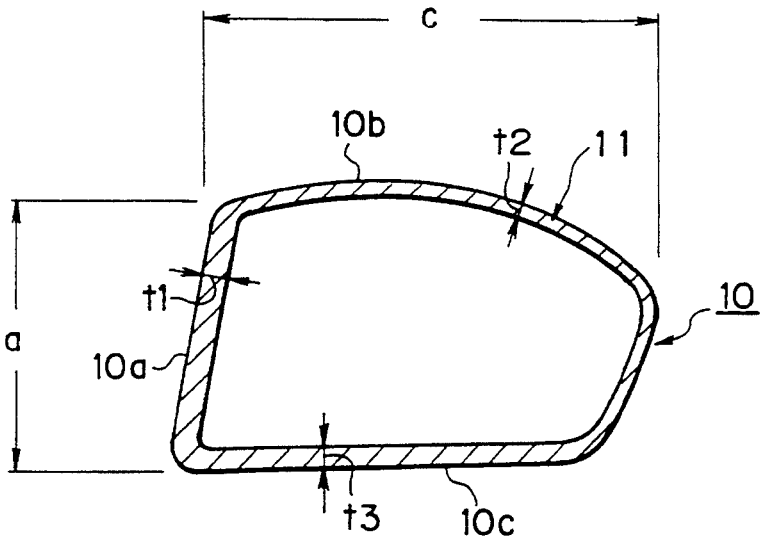
FIG. 1 is a sectional side view of one embodiment of the golf wood club head in accordance with the present invention.
Figure 2:
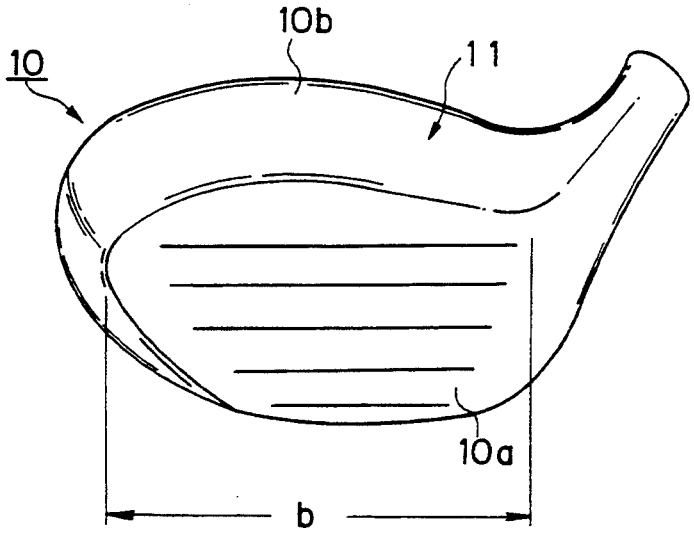
FIG. 2 is a perspective view of the club head.

One embodiment of the golf wood club head is shown in FIGS. 1 to 4, in which a club head main body 10 is made up of a thin metallic shell 11 defining a hollow construction a face 10*a*, a crown 10*b* and a sole 10*c* and the face 10*a* is internally provided with no ribs for reinforcement.

The thickness t1 of the face 10*a* is in a range from 2 to 3.5 mm, the thickness t2 of the crown 10*b* is in a range from 0.6 to 3 mm and the thickness t3 of the sole 10*c* is in a range from 1 to 3 mm. Further, the club head main body 10 is constructed so that the height (the distance between the crown and sole side ends of the face) is 40 mm or larger, the width (the distance between the toe and heel side ends of the face) is 70 mm or larger and the entire volume of the club head is 190 cc or larger.

The club head main body 10 is further constructed so that the moment of inertia is 3000 g*cm$^2$ or larger and the specific inertia value (moment of inertia/specific gravity) is 400 or larger.

Figure 3:
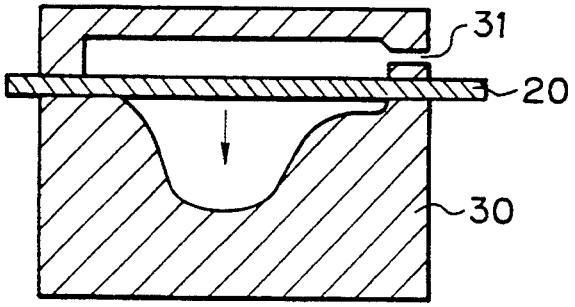
FIG. 3 is a sectional side view of one example of the arrangement for producing the club head of the present invention.
Figure 4:
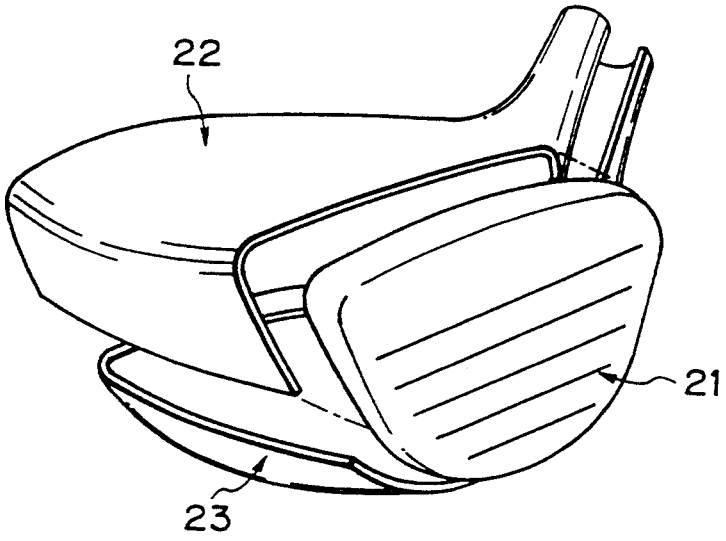
FIG. 4 is a perspective view of section pieces intermediately prepared in production of the club head of the present invention.
Figure 5:
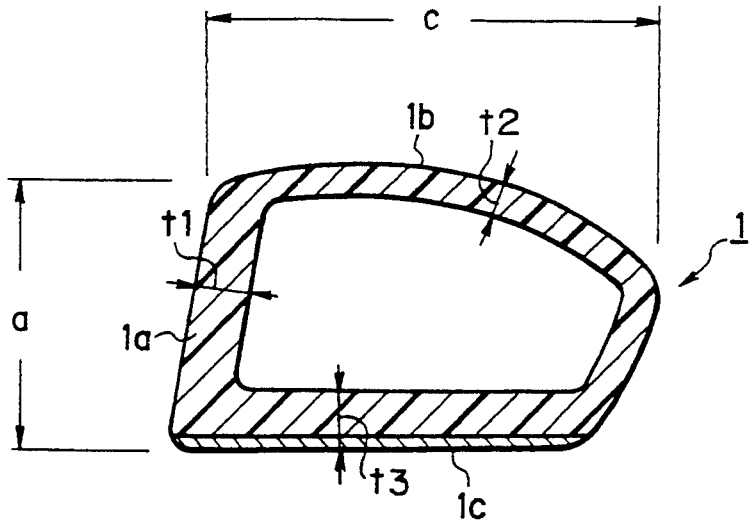
FIG. 5 is a sectional side view of a conventional CFRP club head.
Figure 6:
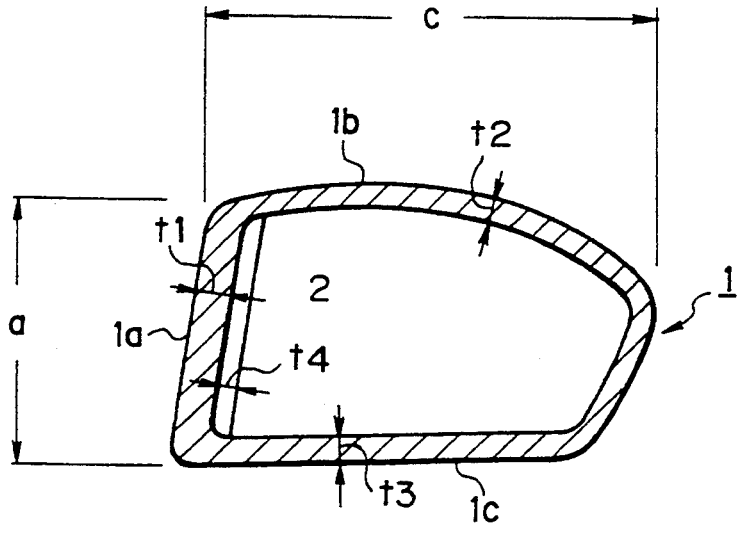
FIG. 6 is a sectional side view of a conventional metallic club head.

One example of production of such a club head main body 10 is shown in FIG. 3, in which a rolled metallic thin plate 20 is used as the starting material. The metallic thin plate 20 is set in place within a mould 30 provided with a cavity of a prescribed shape. The metallic plate 20 is formed thinner within the mould 30 via application of pressing or adequate plastic working. The shell construction of the club head main body 10 is conveniently made up of several separate pieces such as a face section piece 21, a crown section piece 22 and a sole section piece 23. Formation of these section pieces are adjusted so that the entire weight of the club head main body is 210 g or smaller, and more preferably about 200 g. The metallic section pieces 21, 22 and 23 are united together by, for example, welding.

Ultra-plastic alloy of a composition 6A1*4V*Ti (proof stress : 1.1 GPa) and stainless steel (proof stress : 1.27 GPa) are usable for the thin metallic plate 20.

More specifically, production starts with preparation of the mould. That is, a plastic model having a configuration same as the club head main body is formed with, for example, epoxy type resin and a ceramic female mould is prepared on the basic of such a plastic model.

An ultra-plastic Ti alloy thin metallic plate 20 is set in position in the ceramic female mould as shown in FIG. 3 and heated at a temperature in a range from 800° to 900° C . Inert gas such as Ar gas of 1 MPa pressure is introduced into the mould 30 via a gas inlet 31 for gas blow shaping. The strain speed in the gas blow shaping is preferably in a range from $10^{-3}$ to $10^{-4}$/sec. Any strain speed exceeding the upper limit would incur destruction of the mould to lower the uniformity of the product whereas any strain speed falling short of the lower limit would result in greater crystal diameter which seriously lowers the ultra-plastic nature of the material.

The section pieces so shaped are taken out of the mould and, after proper peripheral trimming, united together by, for example, welding into the shape of the ultimate product.

Using the club head models prepared, field tests were conducted. More specifically, club head main body samples A, B and C of different face thickness t1 were prepared and combined with shafts, respectively. Each sample was mounted to a simulation robot which is designed for ball striking practice at a club head speed of 50 m/sec. A comparative sample D and cast samples E and F were subjected to the field tests also and the results are shown in Tables 4 and 5.

TABLE 4

| Sample | Face thickness in mm. | Rib | Face height in mm. | Face width in mm. | Volume in cc. |
|---|---|---|---|---|---|
| A | 3.2 | none | 40 | 70 | 190 |
| B | 3.0 | none | 42 | 80 | 210 |
| C | 2.8 | none | 43 | 85 | 230 |
| D | 3.6 | none | 38 | 67 | 170 |
| E | 3.3 | used | 40 | 80 | 206 |
| F | 3.3 | none | 40 | 80 | 206 |

TABLE 5

| Sample | Moment of inertia (g*cm$^2$) | Flying distance in m. spot | heel | toe | Endurance |
|---|---|---|---|---|---|
| A | 3100 | 240 | 230 | 230 | ○ |
| B | 3300 | 250 | 235 | 240 | ○ |
| C | 3660 | 250 | 240 | 240 | ○ |
| D | 2800 | 220 | 190 | 190 | ○ |
| E | 3200 | 220 | 180 | 190 | ○ |
| F | 3200 | 220 | 190 | 190 | X |

In Table 5 the term "spot" refers to ball striking at the sweet spot of the face, the term "heel" refers to ball striking at a position of 15 mm from the sweet spot towards the heel and the term "toe" refers to ball striking at a position of 15 mm from the sweet spot towards the toe.

When the difference between the sweet spot flying distance and the heel or toe flying distance is smaller than 20 m, the sweet spot is regarded as being enlarged appreciably.

In a different Example, epoxy resin models are prepared for club head of various volumes for formation of corresponding metallic mould. After heating at a temperature from 700° to 900° C., stainless steel plates were used for formation of the section pieces 21, 22 and 23 which were then united together via welding to form the ultimate products.

Samples G, H and I were prepared by combining the produced club head main bodies with shafts, respectively and similar field tests were conducted using the above-described simulation robot under same test conditions. The results are shown in Tables 6 and 7.

TABLE 6

| Sample | Face thickness in mm. | Rib | Face height in mm. | Face width in mm. | Volume in cc. |
|---|---|---|---|---|---|
| G | 3.1 | none | 40 | 70 | 190 |
| H | 2.9 | none | 41 | 75 | 210 |
| I | 2.7 | none | 42 | 80 | 230 |
| J | 3.6 | none | 36 | 65 | 170 |
| K | 3.1 | used | 40 | 70 | 190 |
| L | 3.1 | none | 40 | 70 | 190 |

TABLE 7

| Sample | Moment of inertia (g*cm$^2$) | Flying distance in m. spot | heel | toe | Endurance |
|---|---|---|---|---|---|
| G | 3200 | 240 | 230 | 230 | ○ |
| H | 3400 | 250 | 240 | 240 | ○ |
| I | 3700 | 250 | 240 | 240 | ○ |
| J | 2900 | 220 | 190 | 190 | ○ |
| K | 3200 | 210 | 180 | 190 | ○ |
| L | 3200 | 210 | 180 | 180 | X |

As is clear from the foregoing, specified dimensions of the club head main body in accordance with the present invention fairly enables enlargement of the sweet spot on the face and, as a consequence, increase in moment of inertia which assure long flying distance in intended directions.

Use of a shell construction made of metallic material subjected to plastic working enables formation of a very thin shell including no ribs. Uniform ace condition is thereby obtained without the danger of the conventional cast defect generation.

The elastically flexible nature of the face allows ideal mating of the face with balls at striking with reduced difference in time between flexion of the face and elastic deformation of balls. Elastic recoveries of the two counterparts well concur to increase the flying distance and stabilize the flying direction.

In accordance with a preferred embodiment of the present invention, at least a part of the shell of the club head main body is made of Ti alloy of a composition which contains 3 to 6% by weight of Al, 2 to 4% by weight of V, 1 to 3% by weight of Mo, 1 to 3% by weight of Fe and Ti in balance.

In accordance with a further preferred embodiment of the present invention, at least a part of a club head shell is made of Ti alloy containing 3 to 6% by weight of Al, 2 to 4% by weight of V, 1 to 3% by weight of Mo, 1 to 3% by weight of Fe and Ti in balance, and the shell is then subjected to heating at a temperature in a range from 700° to 900° C. for solution treatment which is followed by a further heating at a temperature in a range from 400° to 600° C. for 1 to 20 hours for aging treatment.

Al is added to the composition since its solid solution into the $\alpha$ phase of Ti alloy raises strength of the a phase. Any percent content below 3% would not provide sufficient strength of the $\alpha$ phase whereas any percent content exceeding 6% would result in an excessive amount of the $\alpha$ phase.

V performs solid solution into the $\alpha$ and $\beta$ phases of the Ti alloy for reinforcement of these phases. When the percent content falls short of 2%, no sufficient reinforcement is expected. When the percent content exceeds 4%, the amount of the $\alpha$ phase is reduced.

Mo is added since it increases the strengths of the $\beta$ phases of the Ti alloy. Any percent content below 1% would result in insufficient reinforcement of the $\beta$ phase. Whereas any percent content above 3% would result in increase in specific gravity and corresponding reduction in specific strength.

Fe is added since its solid solution enhances strengths of the $\beta$ phases of the Ti alloy. When its percent content falls short of 1%, no sufficient reinforcement of the $\beta$ phase is expected. Any percent content above 3% would reduce the amount of the $\alpha$ phase.

In addition to the enlisted components, the composition unavoidably contains impurities such as C, N, O and H. The allowable percent contents for the impurities are 0.10% or smaller for C, 0.05% or smaller for N, 0.20% or smaller for 0 and 0.013% or smaller for H.

With the above-described composition of the club head Ti alloy, the face thickness should preferably be in a range from 2 to 4 mm and the club head volume should preferably be 210 cc or larger.

In production of the club head main body of this embodiment, Ti alloy material is first formed into a desired club head configuration by proper plastic working as described in connection with the foregoing embodiments.

Solution treatment is employed for the purpose of sufficient mechanical reinforcement. The treatment is carried out at a temperature in a range from 700° to 900° C., and more preferably from 800° to 850° C. The treatment should preferably last 10 to 30 minutes, and more preferably from 30 to 120 minutes.

When the temperature falls short of 700° C., low mechanical strength is resulted whereas any temperature above 900° C. would cause lowering in mechanical elongation. When the treatment lasts shorter than 10 minutes, no sufficient effect of the solution treatment is expected. No increased effect is obtained if the treatment lasts longer than 300 minutes.

The solution treatment is followed by the aging treatment. This aging is preferably carried out at a temperature in a range from 400° to 600° C., and more preferably from 450 to 550. The aging should preferably last from 1 to 20 hours, and more preferably from 5 to 10 hours.

When the temperature is below 400° C., there is inevitable reduction in mechanical elongation. When the temperature exceeds 600° C., the mechanical strength is lowered. Reduction in mechanical elongation is resulted from any treatment shorter than 1 hour. Any treatment longer than 20 hours would incur undesirable reduction in mechanical strength.

Figure 7:
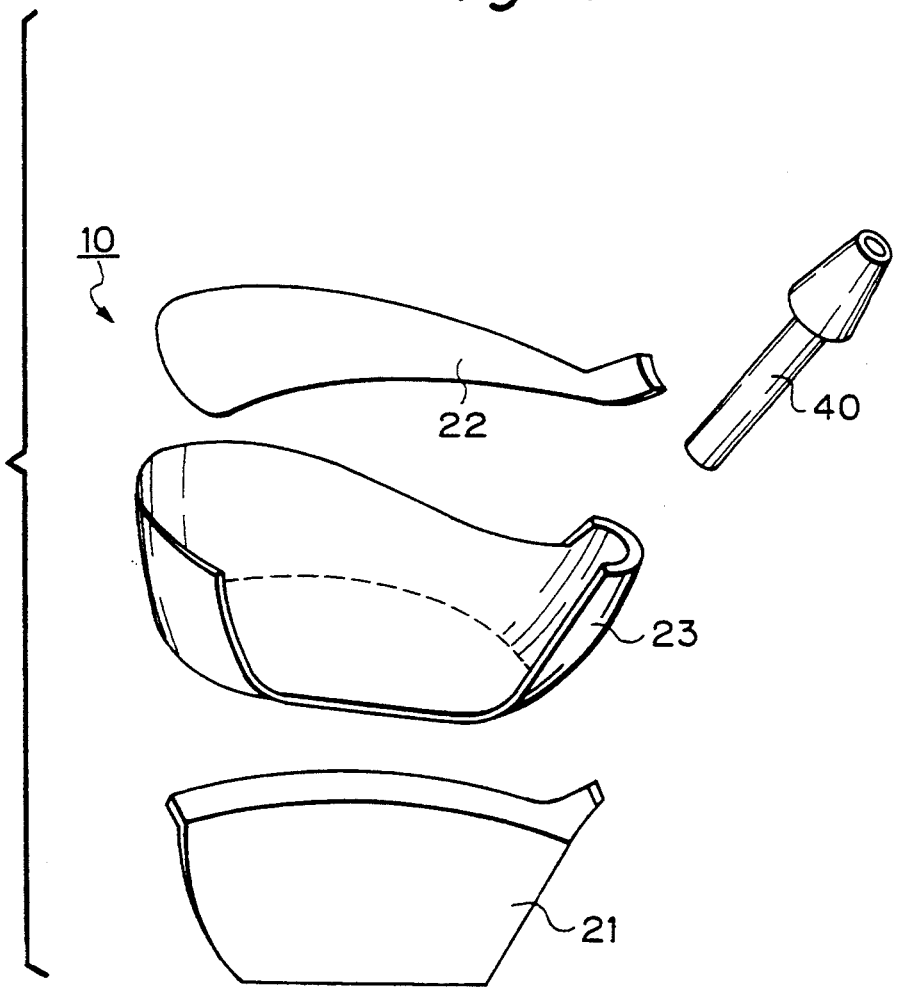
FIG. 7 is a perspective view of one example of the production method in accordance with the present invention.

After preparation of the material Ti plate, various section pieces such as a face section piece 21, a crown section piece 22 and a sole section piece 23 are prepared as in the case of the foregoing embodiments (see FIG. 7). These pieces 21 to 23 are united together and further with a hosel 40.

These pieces 21 to 23 are made of the Ti alloy specified above. One example of such a Ti alloy contains 4.7% by weight of Al, 2.9% by weight of V, 2.0% by weight of Mo, 2.1% by weight of Fe and Ti and impurities in balance. The material Ti alloy is first molten by, for example, vacuum arc re-solution process to form a cast block which is then subjected to hot and cold rolling to form a thin plate.

Moulding is carried out preferably at a temperature in a range from 700° to 1100° C. via hot pressing, and more preferably from 800° to 850° C. The hosel 40 is prepared by cutting a circular rod.

The club head made up of the united section pieces is subjected to solution treatment at, for example, 800° C. for 1 hour within an Ar gas environment. After subsequent abrupt cooling, the club head is subjected to aging treatment at, for example, 510° C. for 6 hours. With these process conditions, the product has a proof stress of 1.20 GPa, a tensile strength of 1.30 GPa and an elongation of 6%.

Figure 8A:
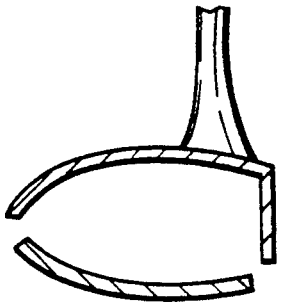
FIGS. 8A to 8C are sectional side views of various club head section piece combinations.
Figure 8B:
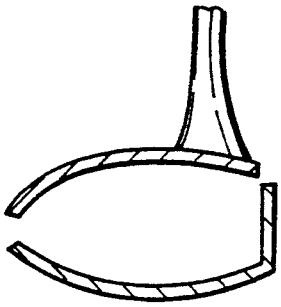
Figure 8C:
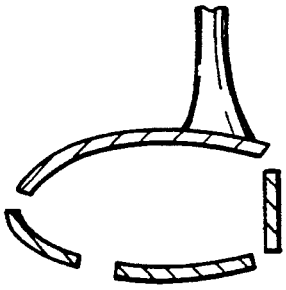

In the case of the example shown in FIG. 7, the club head 10 is made up of the three section pieces 21 to 23. Some alternatives are shown in FIGS. 8A to 8C. In the example shown in FIG. 8A, a crown section piece is formed in one body with a face section piece, a sole section piece is formed in one body with a face section piece in the example shown in FIG. 8B, and the rear section of the club head is divided into two section pieces in the example shown in FIG. 8C.

As in the foregoing embodiments, quality tests were conducted to quantatively evaluate the merits of the invention. The resultant mechanical properties are given in Table 8 with those of the conventional products. In the Table, sample M is made of fine cast material (6Al-4Ti), sample N is made of pure Ti prepared by uniting section pieces and sample 0 is the product of the present invention.

TABLE 8

| Sample | 0.2% proof stress in GPa | Tensile strength in GPa | Elongation in % |
|---|---|---|---|
| M | 0.80~1.10 | 0.90~1.20 | 3~20 |
| N | 0.20~0.80 | 0.30~0.90 | 10~50 |
| O | 1.00~1.40 | 1.10~1.60 | 3~20 |

Next the three types of club head samples were subjected to field tests to confirm the relationship between the volume and the moment of inertia as well as the endurance. The head speed was 40 m/sec and the head weight was 200g. The results are shown in table 9.

TABLE 9

| Sample | Volume in cc. | Moment of inertia (g*cm$^2$) | Endurance |
|---|---|---|---|
| M | 200 | 3200 | 10000 strikes |
| | 210 | 3350 | 10000 strikes |
| | 220 | 3510 | cracks at 500 strikes |
| N | 160 | 2570 | 10000 strikes |
| | 170 | 2720 | 10000 strikes |
| | 180 | 2860 | depression at 300 strikes |
| O | 200 | 3210 | 10000 strikes |
| | 210 | 3340 | 10000 strikes |
| | 220 | 3510 | 10000 strikes |
| | 230 | 3670 | 10000 strikes |

TABLE 9-continued

| Sample | Volume in cc. | Moment of inertia (g*cm$^2$) | Endurance |
|---|---|---|---|
| | 240 | 3850 | 10000 strikes |
| | 250 | 3980 | 10000 strikes |
| | 260 | 4160 | cracks at 300 strikes |

We claim:

1. A metal wood type golf head, comprising a hollow metallic shell having a face, a crown, a sole and a volume defined by its external dimensions, said face, said crown and said sole each having respective thicknesses, said thickness of said face being in a range from 2 to 4 mm and said volume being 190 cc or larger, at least a part of said face being made of Ti alloy of a composition which contains 3 to 6% by weight of Al, 2 to 4% by weight of V, 1 to 3% by weight of Mo. 1 to 3% by weight of Fe and Ti in balance.

2. A golf wood club head as claimed in claim 1 in which said thickness of said face is in a range from 2 to 3.5 mm, the head has a height of 40 mm or larger and has a width of 70 mm or larger.

3. A golf wood club head as claimed in claim 1 in which the thickness of said face is in a range from 2 to 3.5 mm, the thickness of the crown is in a range from 0.6 to 3 mm and the thickness of the sole is in a range from 1 to 3 mm.

4. A golf wood club head as claimed in claim 3 in which said head has a moment of inertia which is 3000 g*cm$^2$ or larger and has a specific inertia value which is 400 or larger.

5. A golf wood club head as claimed in claim 3 in which said head has a weight which is 210 g or smaller.

* * * * *